US007201370B2

(12) United States Patent
Hiramitsu

(10) Patent No.: US 7,201,370 B2
(45) Date of Patent: Apr. 10, 2007

(54) SHEET PROCESSING APPARATUS AND SHEET PROCESSING METHOD

(75) Inventor: Naruaki Hiramitsu, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 137 days.

(21) Appl. No.: 11/009,385

(22) Filed: Dec. 13, 2004

(65) Prior Publication Data

US 2005/0133985 A1 Jun. 23, 2005

(30) Foreign Application Priority Data

Dec. 17, 2003 (JP) ..... P2003-419463

(51) Int. Cl.
*B65H 29/00* (2006.01)

(52) U.S. Cl. ..... 271/186; 271/65; 271/902

(58) Field of Classification Search ..... 271/186, 271/185, 65, 262–263, 902, 184, 225; 209/900
See application file for complete search history.

(56) References Cited

U.S. PATENT DOCUMENTS

| | | | | |
|---|---|---|---|---|
| 5,505,440 | A * | 4/1996 | Uematsu | 271/258.01 |
| 6,419,222 | B1 * | 7/2002 | Morrison et al. | 271/186 |
| 6,726,199 | B2 * | 4/2004 | Ina et al. | 271/65 |
| 7,080,834 | B2 * | 7/2006 | Asari | 271/176 |
| 2004/0163558 | A1 | 8/2004 | Itoh et al. | |
| 2004/0232055 | A1 * | 11/2004 | Reboul et al. | 209/584 |

* cited by examiner

*Primary Examiner*—Patrick Mackey
*Assistant Examiner*—Jeremy R. Severson
(74) *Attorney, Agent, or Firm*—Pillsbury Winthrop Shaw Pittman, LLP

(57) ABSTRACT

A sheet direction inverting apparatus has a switchback portion for inverting the conveying direction of mails and the switchback portion has a drive roller and a driven roller. The length of mails sent to nips of the two rollers in the conveying direction is detected by a sensor, and after switching back, the length of the mails sent from the switchback portion in the conveying direction is detected by a sensor, and an overlapped sheets detector compares detection results. When the detection results are different, the overlapped sheets detector detects overlapping of the mails.

6 Claims, 8 Drawing Sheets

SHEET PROCESSING APPARATUS AND SHEET PROCESSING METHOD

CROSS-REFERENCE TO RELATED APPLICATION

This application is based upon and claims the benefit of priority from the prior Japanese Patent Application No. 2003-419463 filed on Dec. 17, 2003, the entire contents of which are incorporated herein by reference.

FIELD OF THE INVENTION

The present invention relates to a sheet processing apparatus having a detector for detecting overlapping of taken-out sheets and a sheet processing method.

BACKGROUND OF THE INVENTION

For example, as described in U.S. Pat. No. 5,505,440 (Apr. 9, 1996), as an apparatus for processing sheets, a mail processing apparatus for taking out mails one by one and reading information from them, postmarking the position of each postage stamp, and then stacking them respectively on stackers corresponding to reading results is known. This apparatus has a shingler conveyor for positively shifting mails taken out in an overlapped state and detecting overlapping. The mails detected overlapping by the shingler conveyor are rejected without being processed.

The shingler conveyor has a pair of belts for holding mails and moving in the same direction at different speeds and also has an upper stream side sensor for detecting the length of each of mails sent to the shingler conveyor in the conveying direction and a lower stream side sensor for detecting the length of each of mails sent out from the shingler conveyor in the conveying direction. And, the shingler conveyor compares the lengths of the mails measured by the two sensors, judges that when the lengths are different, overlapped sheets are mutually shifted, and detects overlapping.

However, for example, although two mails in the overlapped state are shifted, they cannot be shifted so that the lengths of the mails in the conveying direction are varied and when the shingler conveyor cannot detect overlapping of the sheets, to the canceling unit arranged on the lower stream side in the conveying direction, the mails are sent in the overlapping state. In this case, when canceling the stamps with a postmark, a problem arises that the canceling unit cancels the stamp of the mail only on the canceling hub with a postmark or the canceling position is shifted.

SUMMARY OF THE INVENTION

An object of the present invention is to provide a sheet processing apparatus for precisely detecting overlapped sheets.

According to the present invention there is provided a sheet processing apparatus comprising a switchback portion configured to receive conveyed sheets and send them in an opposite direction, thereby invert a conveying direction of the sheets; a first detector to detect lengths of the sheets in the conveying direction before being received by the switchback portion; a second detector to detect lengths of the sheets in the conveying direction after being sent from the switchback portion; and a first overlapped sheets detector to detect overlapping of the sheets when detection results of the first and second detectors are different.

Furthermore, according to the present invention there is provided a sheet processing method comprising inverting a conveying direction of sheets conveyed in a first direction so as to convey them in a second direction opposite to the first direction; detecting lengths of the sheets to be conveyed in the first direction in the conveying direction; detecting lengths of the sheets to be conveyed in the second direction after the conveying direction is inverted in the conveying direction; and detecting that the sheets are overlapped when the detected lengths of the sheets to be conveyed in the first and second directions in the conveying direction are different.

DETAILED DESCRIPTION OF THE INVENTION

Figure 1:
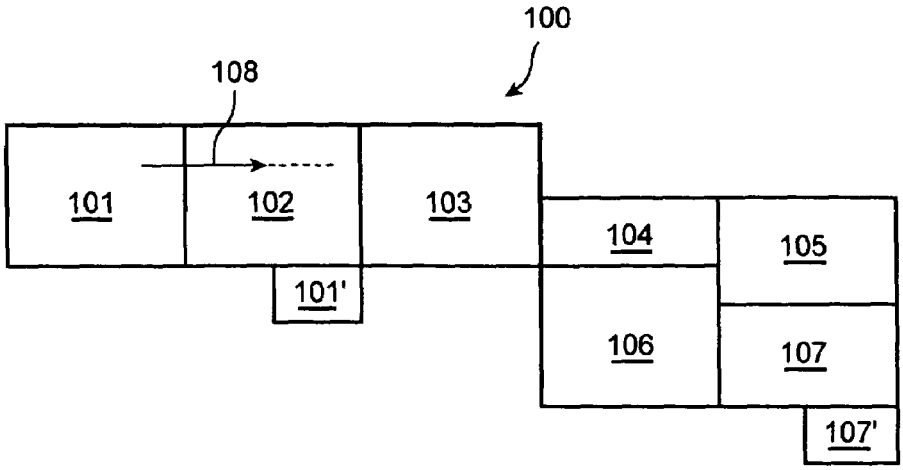
FIG. 1 is a schematic diagram showing the sheet processing apparatus relating to the embodiment of the present invention.

Hereinafter, the embodiment of the present invention will be explained in detail with reference to the accompanying drawings. In FIG. 1, as a sheet processing apparatus relating to the embodiment of the present invention, a schematic diagram of mail processing apparatus 100 (hereinafter, referred to as just processing apparatus 100) is shown.

Processing apparatus 100 has, in the conveying direction of mails M (sheets), feed hopper 101, detector 102 (second overlapped sheets detector), OCR scanner 103, twist inverting unit 104, switchback portion 105, canceling unit 106, sorted sheets stacker 107, and conveying portion 108 for conveying mails M through the units. Further, processing apparatus 100 has an operation panel not shown in the drawing for instructing various operations to the apparatus, switching the operation mode, and displaying errors. Further, when detector 102 detects overlapping of mails M, first reject portion 102' for rejecting mails M is installed in the neighborhood of detector 102. Furthermore, as described later, when overlapped sheets detector 110 detects overlapping of males M, second reject portion 107' for rejecting mails M is installed as a part of sorted sheets stacker 107.

Feed hopper 101 receives a large amount of standard-size mails M (the length in the conveying direction may be different) having a thickness within a predetermined range and a fixed width in the direction perpendicular to the conveying direction, takes out them one by one, and feeds them to the processor on the latter stage. Conveying portion 108 conveys fed mails M via processors 102 to 107 on the latter stage.

Detector 102 detects metals, foreign substances, and hard substances included in conveyed mails M by conveying portion 108 and detects double taking (that is, overlapping) of mails M and a short gap (the distance between the rear end of first mail M conveyed earlier and the front end of succeeding second mail M conveyed following first mail M is shorter than a predetermined distance). Mails M in which metals, foreign substances, or hard substances are detected, mails M in which double taking, that is, overlapping is detected, and mails M in which a short gap is detected are respectively rejected into first reject portion 102'. Particularly, detector 102, for example, as indicated in U.S. Pat. No. 5,505,440 (Apr. 9, 1996), has a shingler conveyor for shifting overlapped mails M by a pair of belts for holding mails M and moving in the same direction at different speeds, compares the length of mails M sent to the shingler conveyor in the conveying direction with the length of mails M sent out from the shingler conveyor, thereby detects overlapped sheets.

OCR scanner 103 optically reads the surface of each mail M, photo-electrically converts it, and obtains sorted sheets information such as the zip code and recipient address recorded on mail M as an image. Further, OCR scanner 103 detects the existence and position of a postage stamp or postal indicia put on mail M. The directions (front, back, top, and bottom) of mails M fed via feed hopper 101 are variable, so that OCR scanner 103 has at least two scanners for reading both surfaces of mails M.

Inverting unit 104 has a reversion path (not shown in the drawing) for conveying mails M while twisting in an 180° arc around the central axis of mails M extending in the conveying direction. Namely, inverting unit 104 reverses only the front and back without changing the conveying direction of mails M. Further, inverting unit 104 has a bypass route (straight path) (not shown in the drawing) for bypassing sent mails M without sending to the reversion path.

Switchback portion 105 has a switchback structure (described later in detail) for receiving conveyed mails M, sending them in the opposite direction, thereby inverting the conveying direction of mails M. Switchback portion 105, similarly to inverting unit 104 mentioned above, has a bypass route (straight path) (described later) for bypassing the switchback structure.

Canceling unit 106 has a canceling hub not shown in the drawing which rotates by rolling and touching one surface of each mail M to be conveyed. In canceling unit 106, the canceling hub rolls and touches the position of the stamp, thereby cancels the stamp with a postmark. In this embodiment, all mails M conveyed to canceling unit 106 pass inverting unit 104 and switchback portion 105 and as described later, the front and back and the top and bottom are arranged, so that the canceling hub is installed only on one side of the conveying route.

Sorted sheets stacker 107, according to the sorted sheets information detected by OCR scanner 103, stacks sorted sheets of respective mails M at a predetermined sorted sheets position. Further, sorted sheets stacker 107 has second reject portion 107' for rejecting mails M whose overlapping is detected by switchback portion 105 by prohibiting canceling by canceling unit 106.

Figure 2:
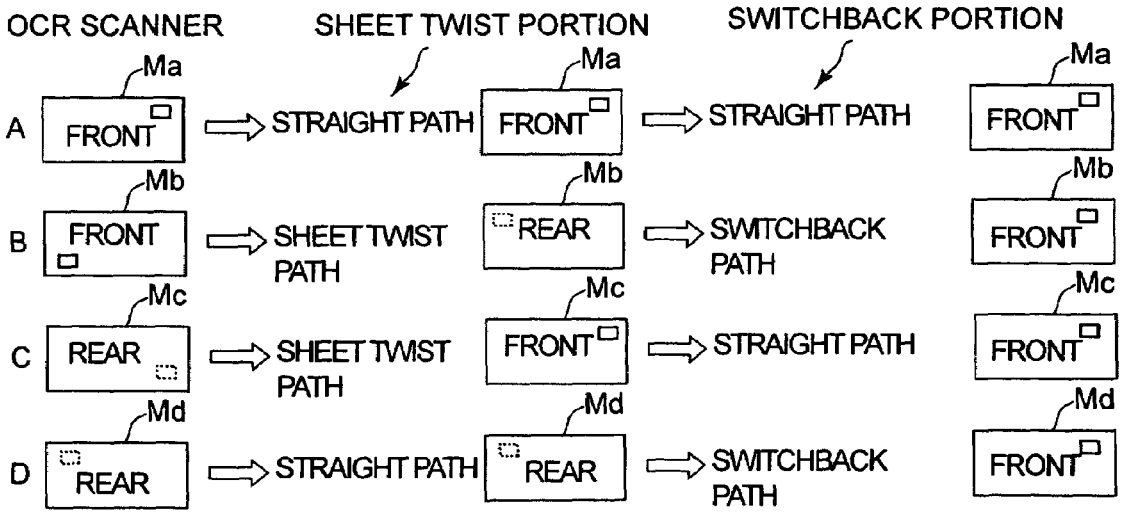
FIG. 2 is an operation illustration for explaining the operation of arranging the front and back and the top and bottom of each mail.

On the other hand, inverting unit 104 and switchback portion 105 have a function for arranging the front and back and the top and bottom of all mails M fed in the state that the front and back and the top and bottom thereof are set variedly as shown in FIG. 2 and sending them to canceling unit 106.

For example, mail Ma whose posture is detected by OCR scanner to be the one indicated by A shown in FIG. 2 passes the straight path of inverting unit 104, then passes the straight path of switchback portion 105, and is sent to canceling unit 106 in the unchanged posture. Further, mail Mb whose posture is detected to be the one indicated by B shown in FIG. 2 passes the reverse path of inverting unit 104, then passes the switchback path of switchback portion 105, is put into the same posture as that of mail Ma, and is sent to canceling unit 106. Further, mail Mc whose posture is detected to be the one indicated by C shown in FIG. 2 passes the sheet twist path of inverting unit 104, then passes the straight path of switchback portion 105, is put into the same posture as that of mail Ma, and is sent to canceling unit 106. Furthermore, mail Md whose posture is detected to be the one indicated by D shown in FIG. 2 passes the straight path of inverting unit 104, then passes the switchback path of switchback portion 105, is put into the same posture as that of mail Ma, and is sent to canceling unit 106. Namely, all mails M passing inverting unit 104 and switchback portion 105 are put into the same posture and are fed to canceling unit 106.

Figure 3:
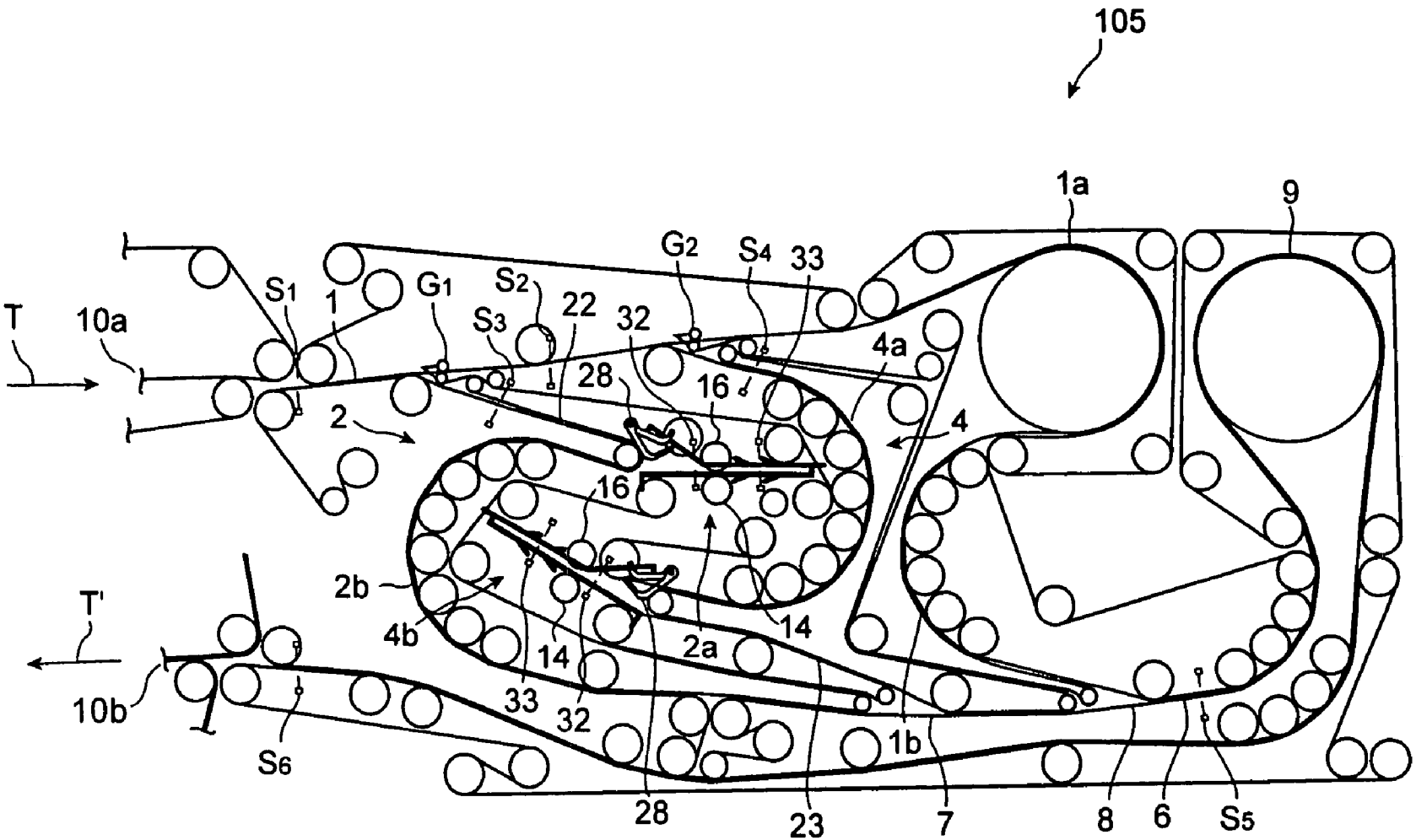
FIG. 3 is a front view showing the structure of a switchback portion to be incorporated into the sheet processing apparatus shown in FIG. 1.

Next, by referring to FIG. 3, the structure of switchback portion 105 mentioned above will be explained more in detail. Switchback portion 105 has main conveying route 1 for conveying mails M in the direction of arrow T shown in the drawing. With respect to all mails M sent to switchback portion 105 via main conveying route 1, the position of each postage stamp is detected by OCR scanner 103. Further, with respect to mails M sent to switchback portion 105, the front and back are inverted by inverting unit 104 when necessary.

On one side (on the lower side in FIG. 3) of main conveying route, first processor 2 and second processor 4 are installed side by side. Further, on main conveying route 1, switching gates G1 and G2 for branching and conveying mails M conveyed via main conveying route 1 respectively to first processor 2 and second processor 4 are installed.

First processor 2 has first switchback structure 2*a* for receiving mails M branched and conveyed from main conveying route 1 via gate G1 and sending them in the opposite direction, thereby inverting the conveying direction of mails M and first U-turn path 2*b* for passing mails M switched back by first switchback structure 2*a*. Namely, mails M branched and conveyed to first processor 2 are switched back first and then are conveyed by a U-turn. And, mails M passing first processor 2 and inverted in the conveying direction, via conveying route to an exit 6, installed under first and second processors 2 and 4 in the drawing, extending almost in parallel with main conveying route 1, are conveyed in the direction of arrow T' shown in the drawing and are sent to canceling unit 106.

Second processor 4 has second U-turn path 4*a* for passing mails M branched and conveyed from main conveying route 1 via gate G2 and second switchback structure 4*b* for receiving mails M passing second U-turn path 4*a*, sending them in the opposite direction, thereby inverting the conveying direction thereof. Namely, mails M branched and conveyed to second processor 4 are firstly conveyed by a U-turn and then are switched back. And, mails M passing second processor 4 and inverted in the conveying direction are led to conveying route to an exit 6 via unification portion 7 and is sent to canceling unit 106.

Further, main conveying route 1, via unification portion 8 on the lower stream side of two gates G1 and G2 in the conveying direction, is connected to conveying route to an exit 6 on the lower stream side of unification portion 7 in the conveying direction. Main conveying route 1 on the upper stream side of unification portion 8 is curved via drum roller 1*a* and U-turn path 1*b* (bypass route, straight path). And, mails M passing gates G1 and G2 and passing first and second processors 2 and 4 are not inverted in the front and back and the top and bottom and are sent to canceling unit 6 via main conveying route 1 and conveying route to an exit 6. Further, the length of each conveying route mentioned above and the processing time of first and second switchback structures 2*a* and 4*b* are designed so that mails M sent to switchback portion 105 via main conveying route 1 are all conveyed to unification portion 8 on conveying route to an exit 6 in the same time.

Further, in switchback portion 105, first switchback structure 2*a* of first processor 2 is arranged in a nest shape inside second U-turn path 4*a* of second processor 4. Further, second switchback structure 4*b* of second processor 4 is arranged in a nest shape inside first U-turn path 2*b* of first processor 2. In other words, fist switchback structure 2*a* and second switchback structure 4*b* are arranged so as to be overlapped with each other and first U-turn path 2*b* and second U-turn path 4*a* are arranged so as to be overlapped with each other.

Namely, by use of a structure that mails M are switched back by one processor, and then the front and back thereof are inverted, and mails M are inverted in the front and back by the other processor, and then they are switched back, the size of the apparatus in the arranging direction of first and second processors 2 and 4 can be contracted and the apparatus constitution can be miniaturized. Particularly, when the structure that inside the U-turn path of one processor, the switchback structure of the other processor is arranged in a nest shape is used similarly to switchback portion 105 mentioned above, the apparatus size can be effectively miniaturized.

Further, in this embodiment, on the lower stream side of unification portion 8 in the conveying direction, conveying route to an exit 6 makes a U-turn round drum roller 9 and supply portion 10*a* and discharge portion 10*b* of mails M to switchback portion 105 are arranged so as to be set on the left of switchback portion 105 in the drawing.

Further, switchback portion 105 has a plurality of sensors for detecting passing of mails M on each conveying route. Namely, sensor $S_1$ is arranged on main conveying route 1 on the upper stream side of gate G1 in the conveying direction, and sensor $S_2$ is arranged on main conveying route 1 between gates G1 and G2, and sensor $S_3$ (first detector) is arranged on the conveying route branched toward first processor 2 at gate G1, and sensor $S_4$ (first detector) is arranged on the conveying route branched toward second processor 4 at gate G2, and sensor $S_5$ (second detector) is arranged on conveying route to an exit 6, and sensor $S_6$ is arranged in the neighborhood of discharge portion 10*b* of mails M.

Figure 4:
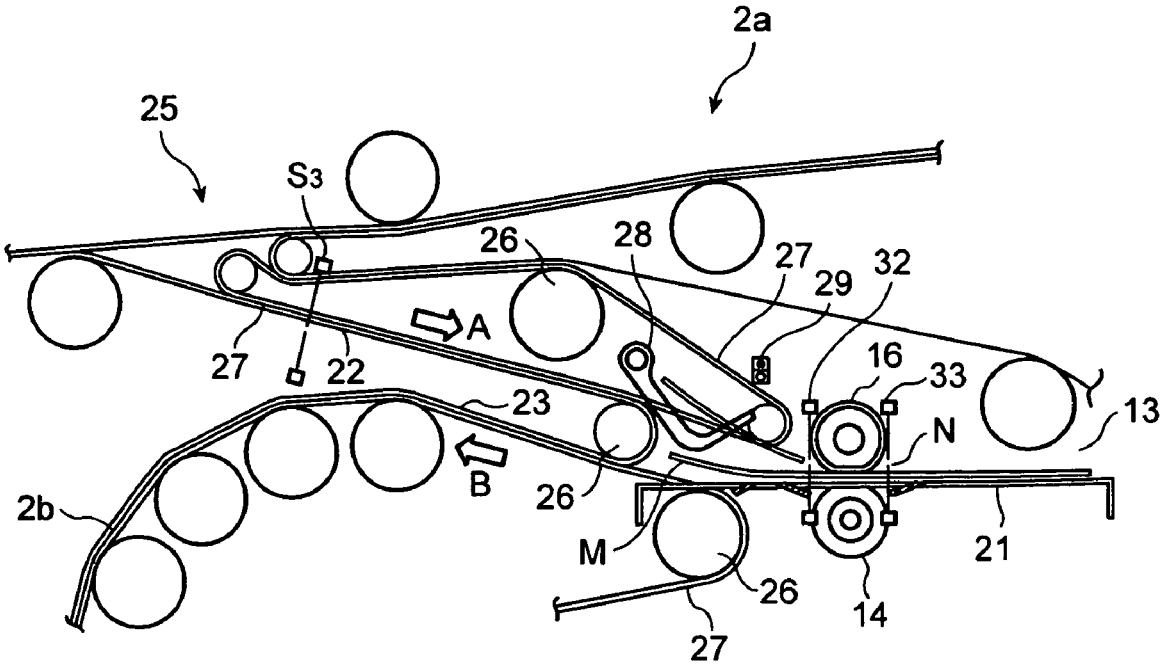
FIG. 4 is a partially enlarged view showing one switchback structure of the switchback portion shown in FIG. 3.
Figure 5:
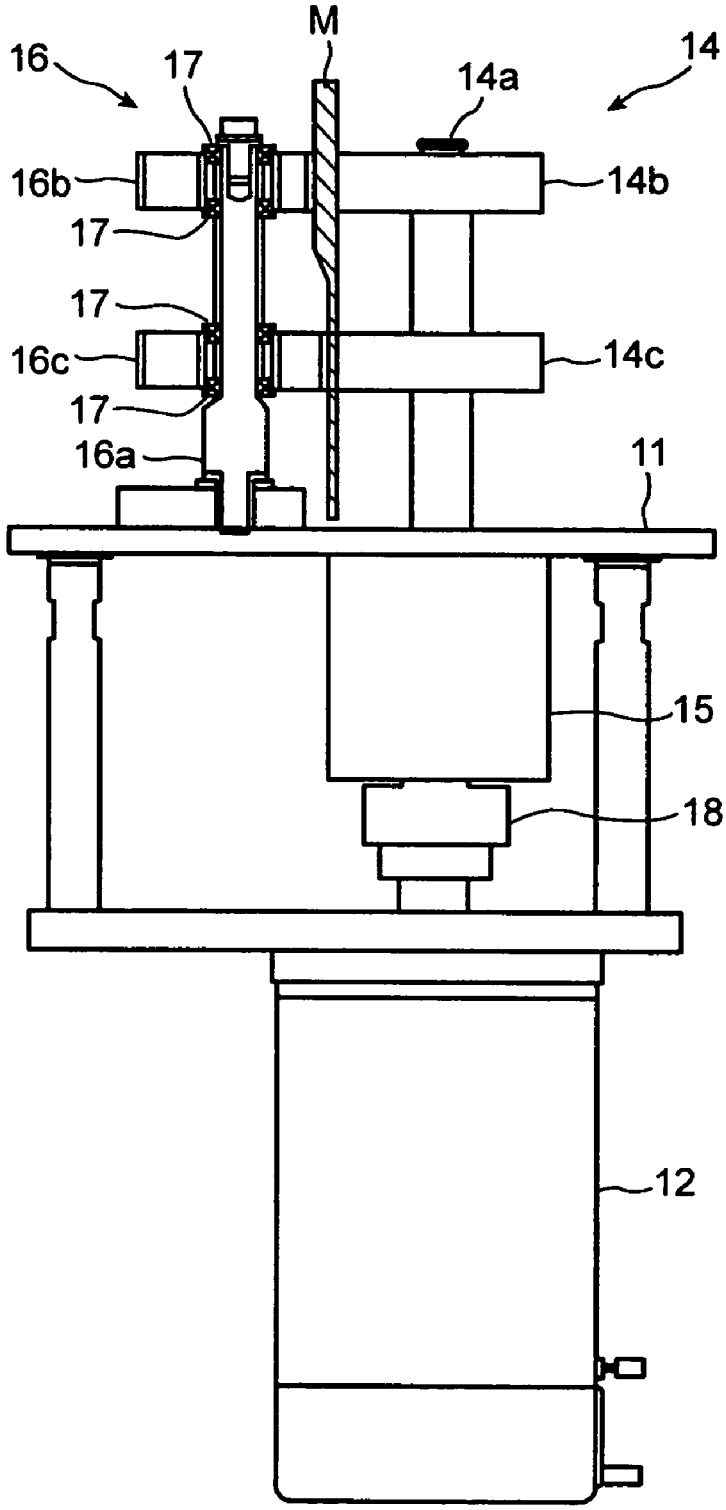
FIG. 5 is a side view of the switchback structure shown in FIG. 4.

Hereinafter, switchback structure 2*a* mentioned above will be explained more in detail by referring to FIGS. 4 to 7. FIG. 4 is a plan view showing the detailed structure of first switchback structure 2*a*. Further, FIG. 5 is a side view of first switchback structure 2*a* viewed in the direction (the direction of arrow A in FIG. 4) of sending mails M. Further, second switchback structure 4*b* has a structure that first switchback structure 2*a* is inverted right and left, so that here, first switchback structure 2*a* will be explained representatively and the explanation of second switchback structure 4*b* will be omitted.

First switchback structure 2*a* (hereinafter, referred to as just switchback structure 2*a*) has drive roller 14 and driven roller 16 rotating forward and backward by motor 12 (FIG. 5). Rollers 14 and 16 are mutually pressed via conveying route 13. Further, switchback structure 2*a*, via nips N between two rollers 14 and 16, has guide plate 21 extending along the bottom side of conveying route 13.

Drive roller 14 has rotating shaft 14*a* extending almost perpendicularly and two roller portions 14*b* and 14*c*. Two roller portions 14*b* and 14*c* are fixed to rotating shaft 14*a* separated vertically from each other along rotating shaft 14*a*. The base end of rotating shaft 14*a* is attached rotatably and fixedly to main body 11 of switchback portion 105. Namely, in main body 11, housing 15 having a plurality of incorporated bearing not shown in the drawing are fixed and rotating shaft 14*a* is extended through the housing. Further, to the base end of rotating shaft 14*a* extended through housing 15, the rotating shaft of motor 12 is directly connected.

On the other hand, driven roller 16 has rotating shaft 16*a* fixed to main body 11. Rotating shaft 16*a* does not rotate for main body 11. On rotating shaft 16*a*, two roller portions 16*b* and 16*c* (described later) formed by an elastically deformable material are installed separately from each other in the axial direction and are independently attached rotatably to rotating shaft 16*a*. Namely, two roller portions 16*b* and 16*c* are attached respectively to rotating shaft 16*a* via two bearings 17. Further, two roller portions 16*b* and 16*c* are respectively positioned so as to roll and touch two roller portions 14*b* and 14*c* of opposing drive roller 14.

The inter-shaft distance between drive roller 14 and driven roller 16 is set so that roller portions 14*b*, 16*b*, 14*c*, and 16*c* are pressed via conveying route 13. Namely, rotating shafts 14*a* and 16*a* of two rollers 14 and 16 are respectively attached to main body 11 with a fixed position relationship, so that roller portions 16*b* and 16*c* of driven roller 16 are elastically deformed as shown in the drawing, thus pressure is generated between the two. Further, roller portions 16*b* and 16*c* of driven roller 16 are elastically deformed, thus mails M are permitted to pass.

Further, switchback structure 2*a* has take-in conveying route 22 for sending mails M toward nips N in the direction of arrow A shown in the drawing and take-out conveying route 23 for sending mails M in the opposite direction from nips N, that is, in the direction of arrow B shown in the drawing. Namely, switchback structure 2*a* has conveying structure 25 for conveying mails M in the direction of arrow A via take-in conveying route 22 and conveying mails M in the direction of arrow B via take-out conveying route 23.

Conveying structure 25 has a plurality of conveying rollers 26 and a plurality of endless conveying belts 27 wound and stretched round conveying rollers 26.

Further, on take-in conveying route 22, sensor $S_3$ mentioned above for detecting passing of mails M is installed. Sensor $S_3$ is installed, on the basis of the time from passing of the front end of each mail M in the conveying direction to passing of the rear end thereof in the conveying direction, to detect the length of each mail M in the conveying direction. Sensor $S_3$ is installed to obtain deceleration, stop, and acceleration timing of drive roller 14 and is installed to detect overlapping of mails M. Further, sensor $S_5$ mentioned above functions similarly to sensor $S_3$ and is installed to detect the lengths of mails M in the conveying direction. Further, before and after nips N, sensors 32 and 33 are installed. Two sensors 32 and 33 are installed to detect the existence of mails M at nips N.

Switchback structure 2*a* having the aforementioned structure operates as indicated below. When mails M are sent in the direction of arrow A via take-in conveying route 22 by conveying structure 25, passing of mails M is detected by sensor $S_3$, and the lengths thereof in the conveying direction are detected, and the front ends of concerned mails M in the conveying direction rush into nips N between drive roller 14 and driven roller 16. At this time, drive roller 14 is rotating clockwise and driven roller 16 is follow-rotating in the same direction as that of drive roller 14. When mails M pass nips N, roller portions 16*b* and 16*c* of driven roller 16 are elastically deformed and follow mails M.

And, after mails M rush into nips N, drive roller 14 is decelerated at predetermined timing and mails M are stopped. This state is shown in FIG. 4. At this time, driven roller 16 intends to continue the rotation by the inertia force.

After mails M are stopped, lever 28 is rotated in the posture shown in FIG. 4 by a drive structure not shown in the drawing and taps on the left end of stopped mails M in the drawing. Lever 28, hereafter, is returned to its home position (not shown in the drawing) by sensor 29. By doing this, the concerned end is directed downward to make preparations for the reverse operation.

Hereafter, drive roller 14 is accelerated and rotated in the opposite direction and mail M held and stopped by nips N is accelerated in the direction of arrow B, is transferred to conveying structure 25, and is taken out via take-out conveying route 23. By doing this, the conveying direction of mail M is inverted. Further, when mails M are accelerated in the opposite direction by drive roller 14, driven roller 16 intends to continue to stop by the inertia force.

Figure 6:
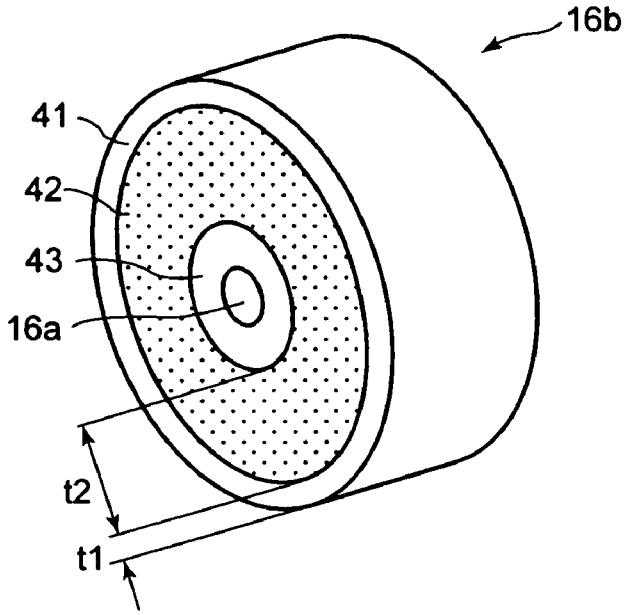
FIG. 6 is a perspective view for explaining the structure of the roller portion of the driven roller of the switchback structure shown in FIG. 4.

Hereinafter, by referring to FIG. 6, roller portion 16*b* of driven roller 16 will be explained more in detail. Further, roller portion 16*c* has the exactly same structure as that of roller portion 16*b*, so that roller portion 16*b* will be explained here representatively.

Roller portion 16*b* has an elastically deformable two-layer structure that the outside first layer in contact with roller portion 14*b* of drive roller 14 is formed by rubber 41 (a solid elastic body) and the inside second layer is formed by sponge 42 (a foamed elastic body). In this embodiment, outside rotation shaft 16*a*, via a bearing not shown in the drawing, aluminum core metal 43 is installed, and sponge 42 is installed outside core metal 43, and rubber 41 is installed outside sponge 42. Further, thickness t1 of rubber 41 is set to 2 [mm], and thickness t2 of sponge 42 is set to 13 [mm], and the diameter of core metal 43 is set to 20 [mm], and the diameter of roller portion 16*b* is set to 50 [mm]. Further, the width of roller portion 16*b* is set to 15 [mm]. Further, roller portions 14*b* and 14*c* of drive roller 14 are also formed by the same rubber material as rubber 41 of roller portions 16*b* and 16*c* of driven roller 16.

As described above, driven roller 16 is arranged fixedly in the state that it is pressed to drive roller 14, so that when mail M is rushed into nips N, driven roller 16 will not spring up from conveying route 13. Namely, in this case, driven roller 16 is deformed according to the thickness of mails M as shown in FIG. 5 and holds and conveys mails M passing nips N while always giving pressure to them. Therefore, the conveying force by drive roller 14 is effectively transferred to mails M and mails M are prevented from changing in the conveying speed.

Figure 7:
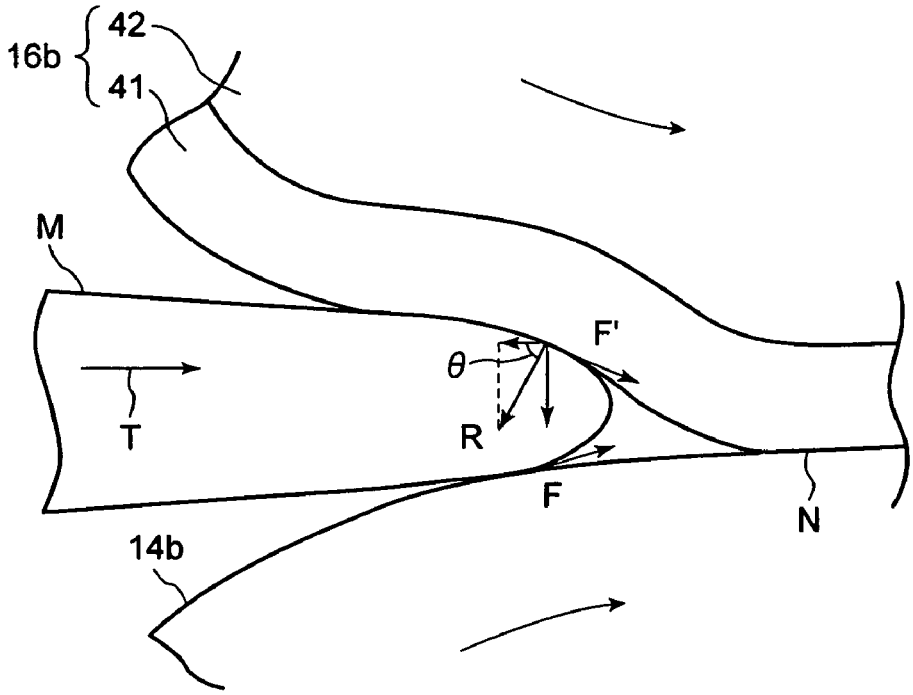
FIG. 7 is a schematic view for explaining the behavior when a mail enters between the drive roller and the driven roller.

Next, by referring to FIG. 7, the behavior of driven roller 16 (roller portion 16*b*) and mails M when mails M rush into nip N will be considered. Further, driven roller 16, in the state before mails M reach nip N, rolls and touches drive roller 14 so as to transfer the drive force and follow-rotates in the direction of the arrow shown in the drawing.

When mails M rush into nip N, roller portion 16*b* is crushed and mails M are slowly held betweem it and roller portion 14*b* of drive roller 14. At this time, roller portion 16*b* gives force R perpendicular to the roller surface to mails M. Therefore, on mails M, reaction force RCosθ pressing back mails M in the opposite direction of the converying direction (the directiion of arrow T shown in the drawing) is acted. Reaction force RCosκ increases as mails M become thicker.

On the other hand, mails M are conveyed in the direction of arrow T by conveying force F based on the rotation of roller portion 14*b* and conveying force F' base don the rotation (follow rotation) of roller portion 16*b*. Therefore, if the resultant force of conveying forces F and F' acting on mails M is sufficiently larger than reaction force RCosθ, mails M are normally conveyed, while when conveying forces F and F' are reduced, defective conveyance is caused.

Names, when the dynamic friction coefficients of roller portions 14*b* and 16*b* to mails M are low, conveying forces F and F' are reduced and the aorementioned effect of reaction force RCosθ is increased. Therefore, to normally convey mails M, it is necessary to increase conveying forces F and F', that is, the dynamic friction coefficients of roller portions 14*b* and 16*b* to mails M as large as possible.

Further, to obtain normal conveying performance, other than increasing the dynamic friction coeeficient, a method for reducing the elasticity of roller portion 16*b* so as to decrease reaction force RCosθ may be considered. Therefore, in this embodiment, roller portion 16*b* has a two-layer structure internally having sponge 42. Further, the hardness and thickness of sponge 42 are necessary conditions for obtaining the follow deformation performance to mails M and a ppropriate pressure by mutual action. When the hardness is too high or the thicknes sis too small, follow deformation is difficult, and defective conveyance is caused, and mails M and rive roller 14 (peripheral members included) are damaged. Namely, to normally invert mails M by switchback portion 105 mentioned above, it is necessary to set the dynamic friction coefficient, hardness, and thickness of roller portion 16*b* to appropriate values.

Next, the operation when inverting mails M non-uniform in thickness by switchback portion 105 having the aforementioned structure, particularly taking notice of the behavior of two rollers 14 and 16, will be explained. Further, here, as shown in FIG. 5, a case of conveying mails M non-uniform in thickness such that the thickness of the side (the upper side in the drawing) held and conveyed by two roller portions 14*b* and 16*b* installed above in the axial direction is thicker than the thickness of the side (the lower side in the drawing) held and conveyed by two roller portions 14*c* and 16*c* installed below will be explained.

As described above, roller portions 16*b* and 16*c* of driven roller 16 are formed by an elastically deformable material and according to the thickness of mails M passing nips N between roller portions 14*b* and 14*c* of drive roller 14, the deformation amount thereof is changed. In this embodiment, roller portion 16*b* for holding and conveying the thick side of mails M has a larger deformation mount than that of roller portion 16*c* for holding and conveying the thin side. In other words, in this case, the apparent radius of roller portion 16*b* is smaller than the apparent radius of roller portion 16*c*.

Therefore, as mentioned above, when mails M non-uniform in thickness are sent via conveying route 13 and pass nips N, the angular speed of roller portion 16*b* having a smaller radius is higher than the angular speed of roller portion 16*c* having a larger radius. Namely, the moving speeds of the outer peripheral surfaces of roller portions 16*b* and 16*c* rotating in contact with mails M are the same, so that the angular speed of roller portion 16*b* having a smaller radius is higher. Although the angular speeds are different, the moving speeds of the outer peripherals of roller portions 16*b* and 16*c*, that is, the peripheral speeds are the same.

Inversely, when roller portions 16*b* and 16*c* are fixed to rotation shaft 16*a*, the angular speeds of roller portions 16*b* and 16*c* are physically the same, so that a difference is generated in the peripheral speed between two roller portions 16*b* and 16*c* having different radiuses. When a difference is generated in the peripheral speed between two roller portions 16*b* and 16*c* like this, a difference is generated in the conveying speed of mails M, and mails M are not only crinkled and skewed but also in the worst case, are broken.

Therefore, in this embodiment, roller portions 16*b* and 16*c* are rotatably attached independently of rotation shaft 16*a*. By doing this, the angular speeds of roller portions 16*b* and 16*c* can be made different from each other and the roller portions can respond to mails M non-uniform in thickness.

Namely, according to this embodiment, two roller portions 16*b* and 16*c* installed on the same axle of driven roller 16 can rotate independently of rotation shaft 16*a*, so that even when holding and conveying mails M non-uniform in thickness, mails M can be surely conveyed free of wrinkles, skews, and failures such as ruptures.

Next, the shingler operation for overlapped mails M by switchback portion 105 will be explained by referring to FIGS. 8 to 11. Further, in FIGS. 8 to 11, for simplicity of drawing, sensors $S_3$ and $S_5$ are installed at the same position.

The shingler operation of mails M by switchback portion 105 is performed simultaneously while switchback portion 10 is performing the reverse operation. Here, the shingler operation of mails M by first switchback structure 2*a* will be explained representatively. However, the shingler operation can be performed similarly by second switchback structure 4*b*.

Figure 8:
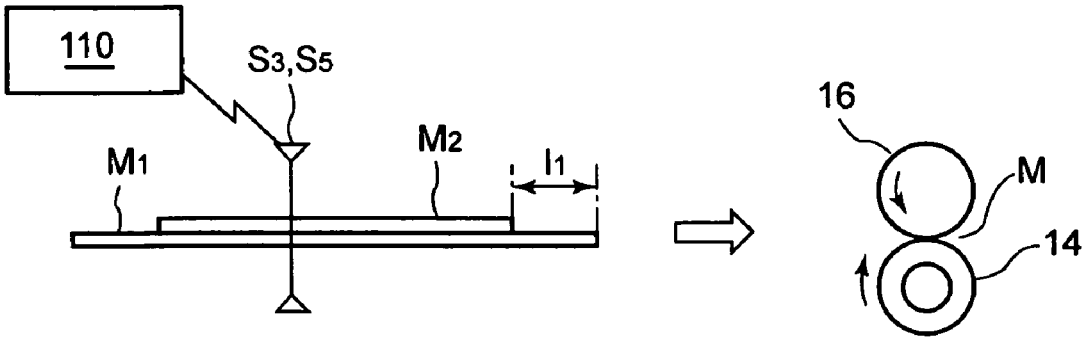
FIG. 8 is a schematic view showing the state that overlapped mails are sent to the switchback portion.
Figure 9:
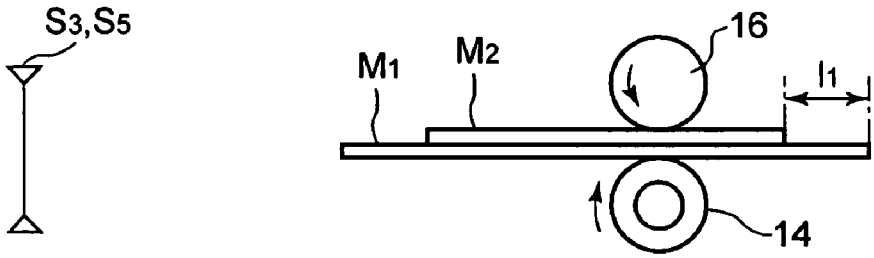
FIG. 9 is a schematic view showing the state that overlapped mails are held and moved between the nips of the drive roller and driven roller rotating in the switchback portion.

As shown in FIG. 8, when two mails M1 and M2 overlapped in the state that the respective front ends are shifted at a distance of $l_1$ pass sensor $S_3$ and are sent to first switchback structure 2*a*, as shown in FIG. 9, two mails M1 and M2 are overlapped just in the state that the respective front ends are shifted at a distance of $l_1$ and rush into nips N between drive roller 14 and driven roller 16. When mails M1 and M2 rush into nips N, driven roller 16 follows drive roller 14 and rotates at the same peripheral speed as that of drive roller 14.

Hereafter, when drive roller starts deceleration at predetermined timing to invert mails M1 and M2, mail M1 in contact with drive roller 14 also starts deceleration at the same time. On the other hand, mail M2 in contact with driven roller 16 is controlled by driven roller 16 intending to continue the even speed rotation by the inertia force and intends to continue the movement at the uniform rate. In this case, the friction coefficient between rollers 14 and 16 and mails M1 and M2 is larger than the friction coefficient between mails M1 and M2, so that for mail M1 decelerated, mail M2 intending to keep the uniform rate is shifted.

Figure 10:
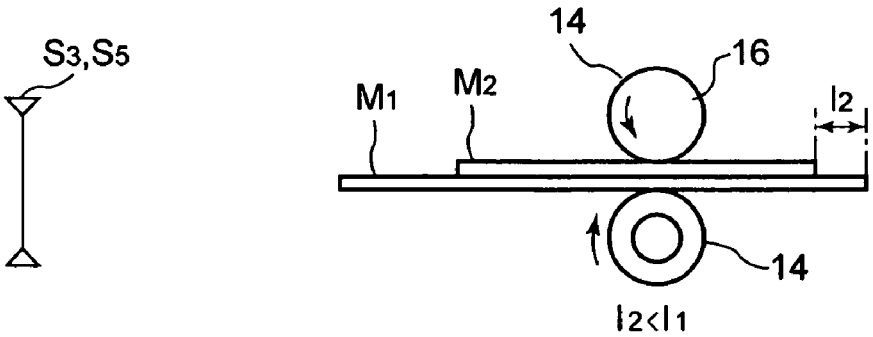
FIG. 10 is a schematic view showing the state that the rotation of the drive roller is stopped and the driven roller keeps rotation by the inertia.
Figure 11:
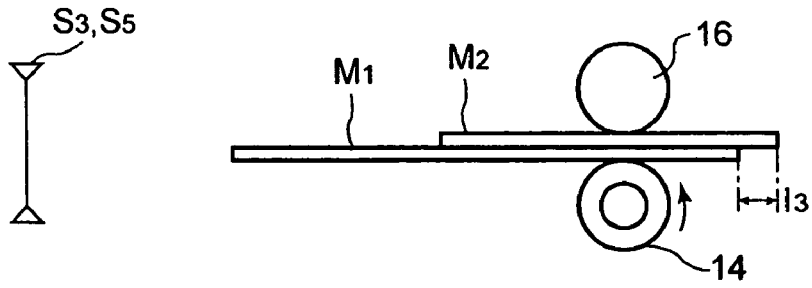
FIG. 11 is a schematic view showing the state that the rotation of the driven roller is stopped and the drive roller starts the reverse rotation.

Furthermore, even when drive roller 14 is stopped, mail M2 intends to continue the movement by the inertia force of driven roller 16, so that two mails M1 and M2 are shifted more and as a result, as shown in FIG. 10, the distance at which the respective front ends of mails M1 and M2 are shifted becomes $l_2$. Distance $l_2$ is shorter than distance $l_1$. And, as shown in FIG. 11, when stopped drive roller 14 starts reverse rotation, this time, driven roller 16 intends to continue the stop by the inertia force thereof, so that mail M2 controlled by driven roller 16 intends to continue the stop. At this time, two mails M1 and M2 are shifted more. As a result, the distance at which the respective front ends (the rear ends in the moving direction) of mails M1 and M2 are shifted becomes $l_3$.

Figure 12:
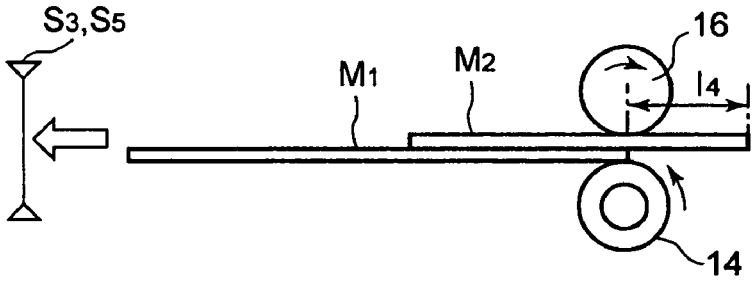
FIG. 12 is a schematic view showing the state that the driven roller makes the driven rotation in correspondence to the reverse rotation of the drive roller.
Figure 13:
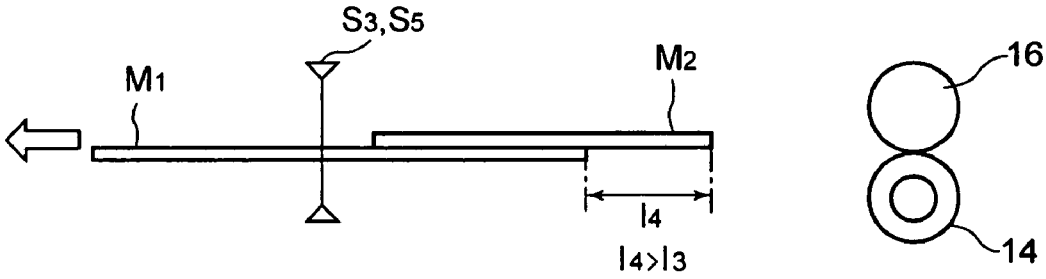
FIG. 13 is a schematic view showing the state that two mails in the shifted state are separated from the switchback portion.

Furthermore, as shown in FIG. 12, when the rear end of mail M on the side of drive roller 14 in the moving direction passes nips N, mail M2 controlled by driven roller 16 until now makes contact with drive roller 14. Hereafter, shifted mail M2 is held and restricted by drive roller 14 and driven roller 16, is given conveying force, and is sent in the opposite direction and as shown in FIG. 13, the distance at which the respective rear ends of mails M1 and M2 are shifted becomes $l_4$ and the mails are moved. Distance $l_4$ is longer than distance $l_3$.

Mails M1 and M2 sent to switchback structure 2*a* in the overlapped state as mentioned above are shifted automatically and surely during the normal reverse operation. When two mails M1 and M2 are shifted by switchback structure 2*a* like this, the lengths of mails M1 and M2 in the overlapped state in the conveying direction are changed. In this embodiment, the lengths of mails M1 and M2 are detected by sensor $S_3$ (in second switchback structure 4*b*, sensor $S_4$) and $S_5$ installed before and after switchback structure 2*a*, and length changes are detected by overlapped sheets detector 110 (first overlapped sheets detector), thus overlapping of mails M is detected. And, for mails M1 and M2 whose overlapping is detected by overlapped sheets detector 110, canceling by canceling unit 106 is inhibited and they are rejected to second reject portion 107' installed in sorted sheets stacker 107.

On the other hand, detector 102 mentioned above also detects overlapping of mails M and rejects them to first reject portion 102'. However, for example, when two mails M1 and M2 mentioned above are shifted by the shingler conveyor and then as shown in FIG. 8, are sent in the state that mail M2 is completely overlapped on mail M1, detector 102 does not detect length changes between mails M1 and M2 in the conveying direction, so that overlapping cannot be detected. Namely, depending on the shift direction and shift amount by the shingler conveyor of detector 102, a case of the state shown in FIG. 8 may be considered. When mails M1 and M2 whose overlapping is not detected by detector 102 like this are sent to canceling unit 106 as they are, a problem arises that only the mail on the canceling hub side is canceled or the normal position is not canceled.

On the other hand, as indicated in this embodiment, switchback portion 105 detects overlapping of mails M, so that even mails M whose overlapping cannot be detected by detector 102 can be surely shifted and detected. Particularly, by matching the shift direction of mails M by detector 102 with the shift direction of mails M by switchback structure 2*a* (4*b*), shifted mails M are prevented from returning to detector 102 and mails M can be shifted more surely.

Figure 14:
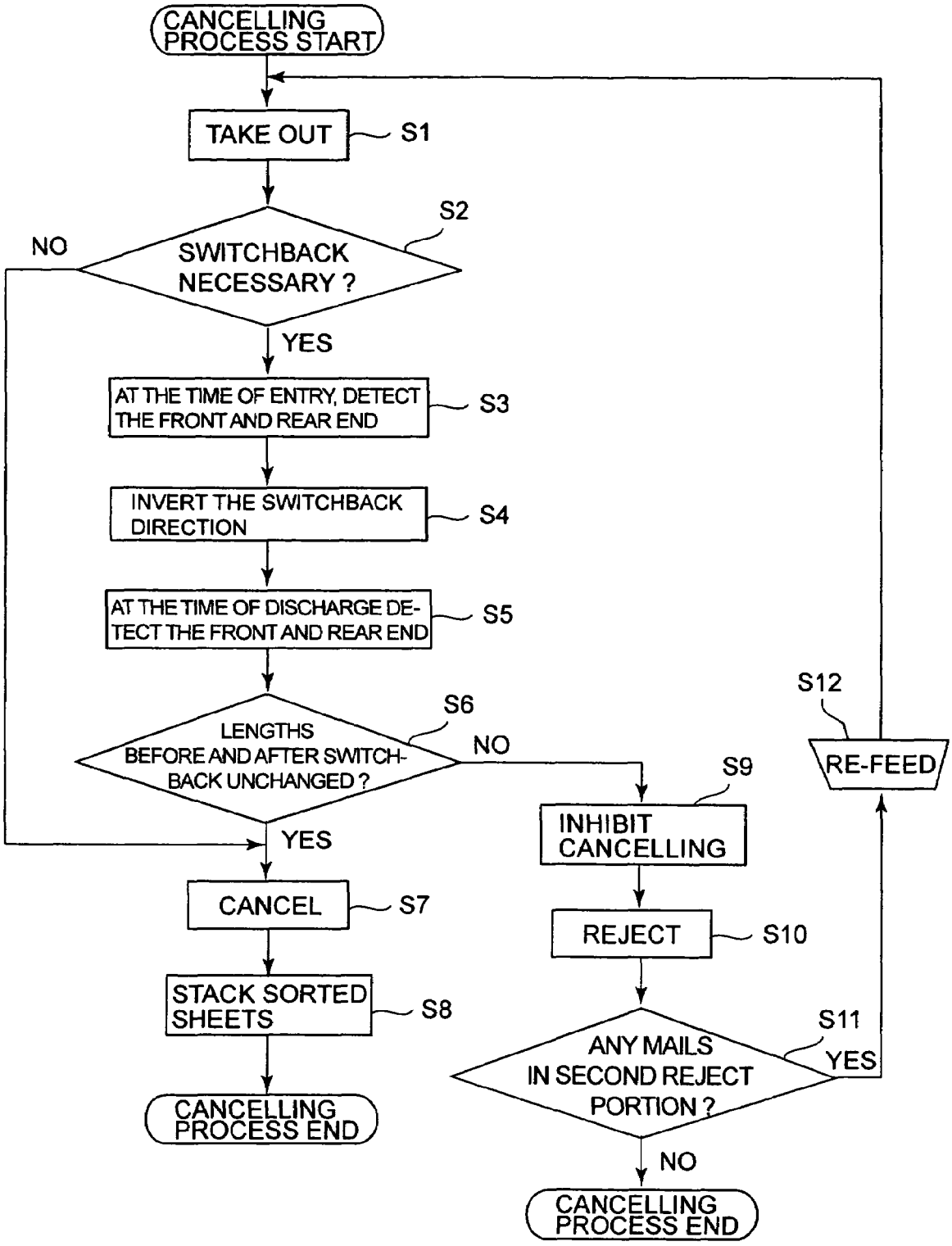
FIG. 14 is a flow chart for explaining the operation of processing mails using the overlapped sheets detection function of the switchback portion.

Hereinafter, by referring to the flow chart shown in FIG. 14, the operation of processing overlapped mails M using the overlapped sheet detection function of switchback portion 105 will be explained.

When mail M is taken out by feed hopper 101 (Step S1), on the basis of detection results by OCR scanner 103, the feed hopper judges whether or not concerned mail M must be switch backed concerned mail M (Step S2).

As a result of judgment at Step S2, when it is judged that concerned mail M must be switched back (Step S2, YES), concerned mail M passes the switchback path of switchback portion 105 and the conveying direction thereof is inverted (Step S4).

At this time, by sensor $S_3$ (or $S_4$), passing of the front and rear ends of concerned mail M to be sent to the switchback path in the conveying direction is detected (Step S3) and from the conveying speed and passing time, the length of concerned mail M in the conveying direction is detected by overlapped sheets detector 110. Further, at this time, by sensor $S_5$, passing of the front and rear ends of concerned mail M passing the switchback path and sent from switchback portion 105 is detected (Step S5) and the length of concerned mail M in the conveying direction is detected by overlapped sheets detector 110.

And, overlapped sheets detector 110 compares the length detected at Step S3 with the length detected at Step S5 and when it judges that the detected lengths are equal (Step S6, YES), overlapped sheets detector 110 judges that one mail M is conveyed normally (not overlap). In this case, concerned mail M is sent to canceling unit 106 as it is, is canceled the stamp with a postmark (Step S7), and is stacked in a predetermined sorted sheets stacker according to detection results by OCR scanner 103 (Step S8).

On the other hand, as a result of judgment at Step S2, when it is judged that there is no need to switch back concerned mail M (Step S2, NO), concerned mail M passes the straight path of switchback portion 105 and is sent to canceling unit 106 and the canceling process at Step S7 and the sorted sheets stacking process at Step S8 are performed.

Further, as a result of judgment at Step S6, when overlapped sheets detector 110 judges that the lengths of concerned mail M in the conveying direction before and after switchback are different (Step S6, NO), overlapped sheets detector 110 judges that concerned mail M is overlapped, inhibits canceling when mail M passes canceling unit 106 (Step S9), and then rejects concerned mail M to second reject portion 107' of sorted sheets stacker 107 (Step S10).

Hereafter, it is judged whether there is rejected mail M in second reject portion 107' or not (Step S11), and when it is judged that there is rejected mail (Step S11, YES), the operation is stopped at predetermined timing, and mail M is taken out from second reject portion 107' by an operator, and it is fed again by hand (Step S12). On the other hand, as a result of judgment at Step S11, when it is judged that there is not mail M in the rejected sheets stacker (Step S11, NO), the operation is finished.

Further, the present invention is not limited straight to the aforementioned embodiment and at the execution stage, within a range which is not deviated from the object of the present invention, the components may be modified and actualized. Further, by appropriate combination of a plurality of components disclosed in the aforementioned embodiment, various inventions can be formed. For example, from all the components indicated in the aforementioned embodiment, some components may be deleted.

For example, in the aforementioned embodiment, as a switchback portion, the structure that the driven roller is pressed to the drive roller is explained as an example. However, the present invention is not limited to it and a switchback portion having a pair of belts that one belt follows the other belt may be used.

Further, the shift direction of overlapped mails M is not limited to the one of the aforementioned embodiment.

Furthermore, sheets are not limited to mails and as other sheets, banknotes and securities may be used.

The sheet processing apparatus of the present invention has the aforementioned constitution and operation, so that overlapped sheets can be shifted by the switchback portion, and overlapping of sheets can be detected easily and surely, and the canceling unit can be prevented from defective canceling. Further, by the sheet processing method of the present invention, overlapping of sheets can be detected easily and surely and defective canceling can be prevented surely.

What is claimed is:

1. A sheet processing apparatus comprising:

a switchback portion configured to receive conveyed sheets and send them in an opposite direction, thereby invert a conveying direction of the sheets;

a first detector to detect lengths of the sheets in the conveying direction before being received by the switchback portion;

a second detector to detect lengths of the sheets in the conveying direction after being sent from the switchback portion; and a first overlapped sheets detector to detect overlapping of the sheets when detection results of the first and second detectors are different, wherein the switchback portion includes a drive roller, driven to rotate in both forward and backward directions, on one side of the sheets, and a driven roller, following the sheets, in a state that the sheets are held between the drive roller and the driven roller, and wherein the switchback portion is so constructed that:

two overlapping sheets are shifted with respect to each other when the rotation of the drive roller is decelerated in the forward direction because a sheet contacting the drive roller slows down according to the deceleration of the drive roller, while the other sheet contacting the driven roller is maintained at a constant speed by inertial rotation of the driven roller; and the two overlapping sheets are more shifted with respect to each other when the drive roller is rotated in the backward direction because the sheet contacting the drive roller moves in the backward direction according to the backward rotation of the drive roller, while the other sheet contacting the driven roller is stopped because the driven roller is maintained at rest by inertia.

2. The sheet processing apparatus according to claim 1 further comprising:

a feed hopper configured to feed the sheets;

a conveying portion configured to convey the fed sheets;

a canceling unit configured to cancel the sheets sent from the switchback portion; and a first reject portion configured to prohibit canceling the sheets whose overlapping is detected by the first overlapped sheets detector by the canceling unit and reject them.

3. The sheet processing apparatus according to claim 2 further comprising:

a second overlapped sheets detector to detect overlapping of the fed sheets; and a second reject portion configured to reject the sheets whose overlapping is detected by the second overlapped sheets detector.

4. A sheet processing method comprising:

inverting a conveying direction of sheets conveyed in a first direction so as to convey them in a second direction opposite to the first direction;

detecting lengths of the sheets to be conveyed in the first direction in the conveying direction;

detecting lengths of the sheets to be conveyed in the second direction after the conveying direction is inverted in the conveying direction; and detecting that the sheets are overlapped when the detected lengths of the sheets to be conveyed in the first and second directions in the conveying direction are different, wherein the inverting of the conveying direction of the sheets is executed by a switchback portion and the switchback portion includes a drive roller, driven to rotate in both forward and backward directions, on one side of the sheets, and a driven roller, following the sheets, in a state that the sheets are held between the drive roller and the driven roller; and shifting two overlapping sheets with respect to each other by decelerating a sheet contacting the drive roller according to the drive roller in deceleration, while maintaining the speed of the other sheet contacting a driven roller by inertial rotation of the driven roller; and shifting the two overlapping sheets to a further degree with respect to each other by driving the sheet contacting the drive roller according to the drive roller in the backward direction while maintaining the other sheet contacting the driven roller at rest by inertia.

5. The sheet processing method according to claim 4 further comprising:

feeding the sheets; conveying the fed sheets in the first direction;

canceling the sheets inverted and conveyed in the second direction; and prohibiting canceling the sheets whose overlapping is detected and rejecting them.

6. The sheet processing method according to claim 5 further comprising:

detecting overlapping of the sheets fed and conveyed in the first direction; and rejecting the sheets conveyed in the first direction when detecting that the sheets conveyed in the first direction are overlapped.

* * * * *